United States Patent [19]

Valentine et al.

[11] 4,403,554

[45] Sep. 13, 1983

[54] PORTABLE EXHIBIT SYSTEM

[75] Inventors: Clark Valentine, El Toro; George E. Bamber, La Crescenta, both of Calif.

[73] Assignee: Good Thumb Company, Los Angeles, Calif.

[21] Appl. No.: 259,276

[22] Filed: Apr. 30, 1981

[51] Int. Cl.[3] ..... A47B 47/00

[52] U.S. Cl. ..... 108/23; 108/111; 211/189; 248/165

[58] Field of Search ..... 108/23, 111, 91, 108, 108/109, 110; 248/466, 165; 211/186, 188, 189; 350/303, 299, 305; 362/128, 135

[56] References Cited

U.S. PATENT DOCUMENTS

| | | | |
|---|---|---|---|
| 2,676,081 | 4/1954 | Smith | 211/186 |
| 3,316,863 | 5/1967 | Zock | 108/108 |
| 3,346,124 | 10/1967 | Sobel | 108/108 |
| 3,406,645 | 10/1968 | Monroe | 108/23 |
| 3,780,281 | 12/1973 | Ohlhauser et al. | 362/128 |
| 3,792,917 | 2/1974 | Martinez | 211/189 |
| 4,067,161 | 1/1978 | Rensch | 108/111 |
| 4,068,855 | 1/1978 | Hackett | 211/189 |
| 4,109,961 | 8/1978 | Opsuik | 108/110 |

*Primary Examiner*—Francis K. Zugel

*Attorney, Agent, or Firm*—Sughrue, Mion, Zinn, Macpeak and Seas

[57] ABSTRACT

The portable exhibit system includes a plurality of display modules each of which has a pair of identical mirror image side support extrusions having a plain display panel or an illuminated display panel detachably connected therebetween. Up to three modules may be vertically interconnected at oblique angles relative to each other to define a display unit having a substantially concave continuous display surface with the bottom module having a pair of horizontal extruded support arms identical to said side support extrusions extending rearwardly therefrom. An illuminated header module may be detachably connected to the top end of the upper module. A plurality of display units each of which is comprised of a plurality of modules may be interconnected in side-by-side or back-to-back relation to provide an expanded exhibit system.

17 Claims, 12 Drawing Figures

FIG. 1
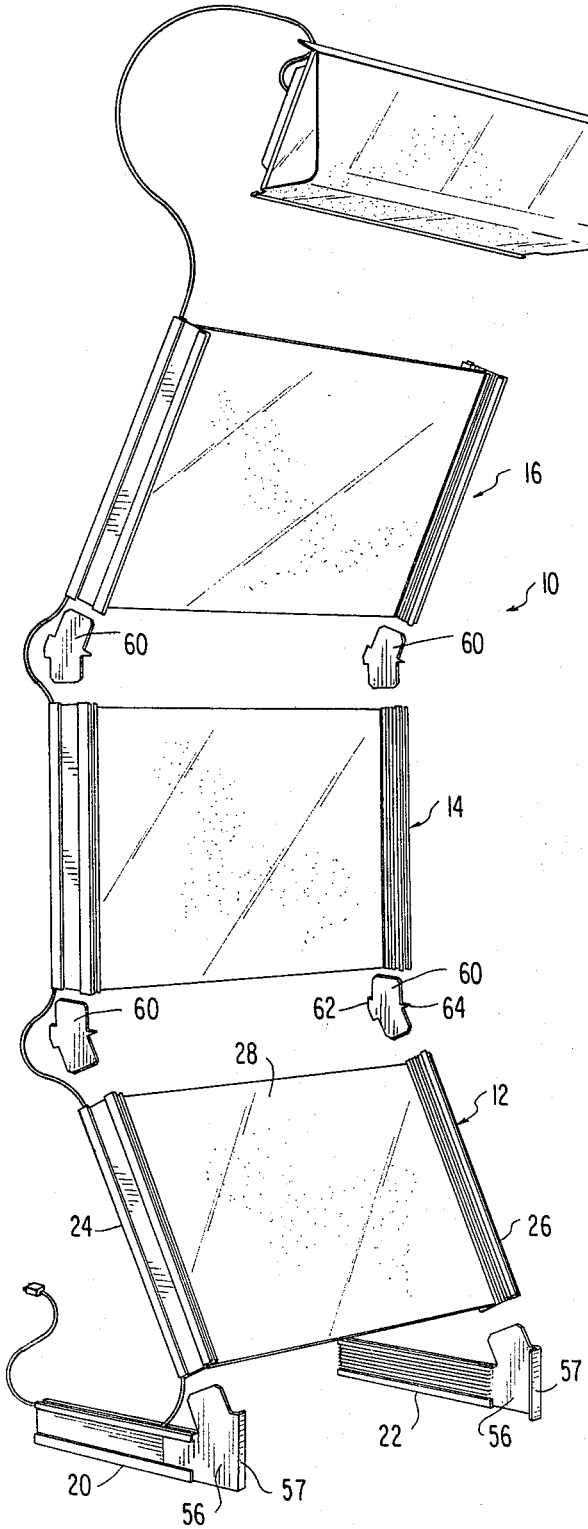
FIG. 2
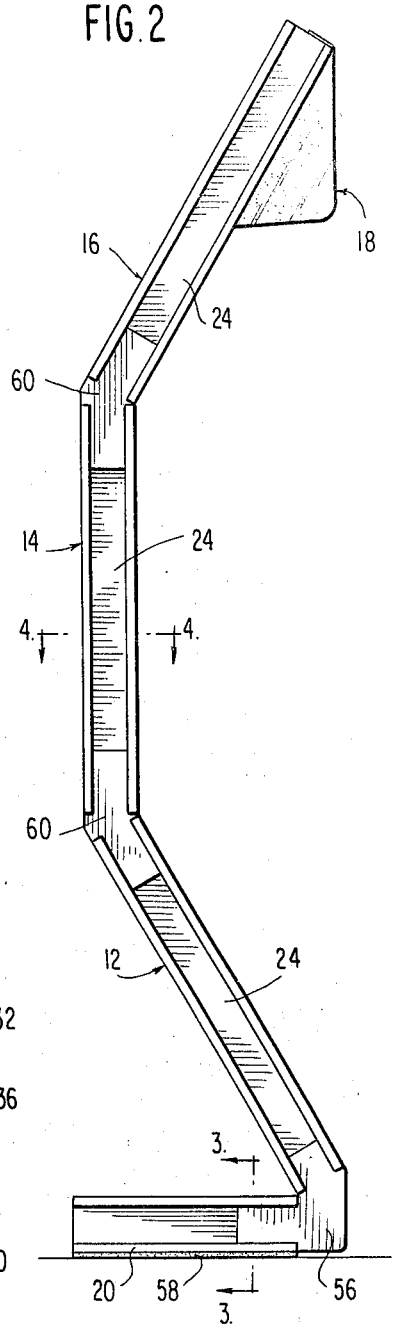
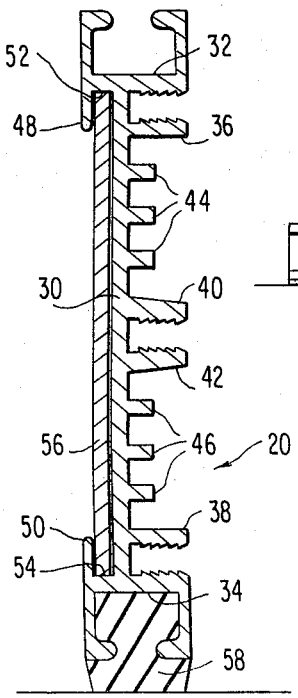
FIG. 3

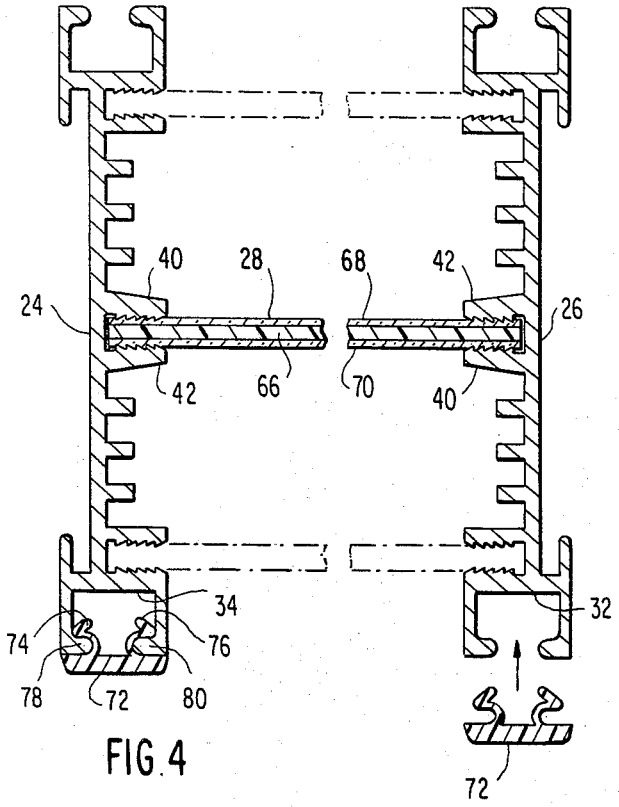
FIG. 4
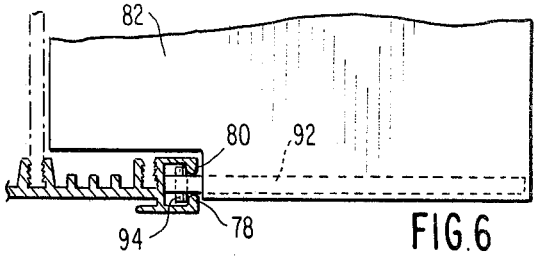
FIG. 6
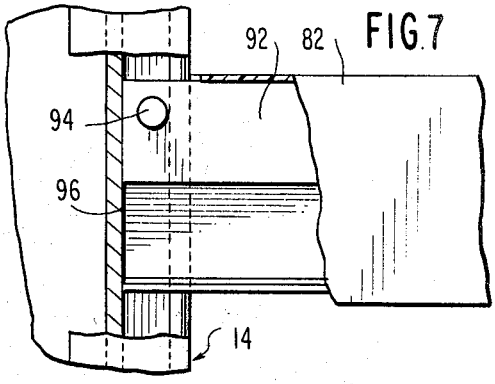
FIG. 7
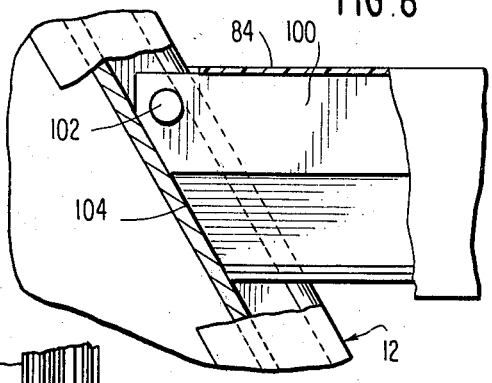
FIG. 8
FIG. 5
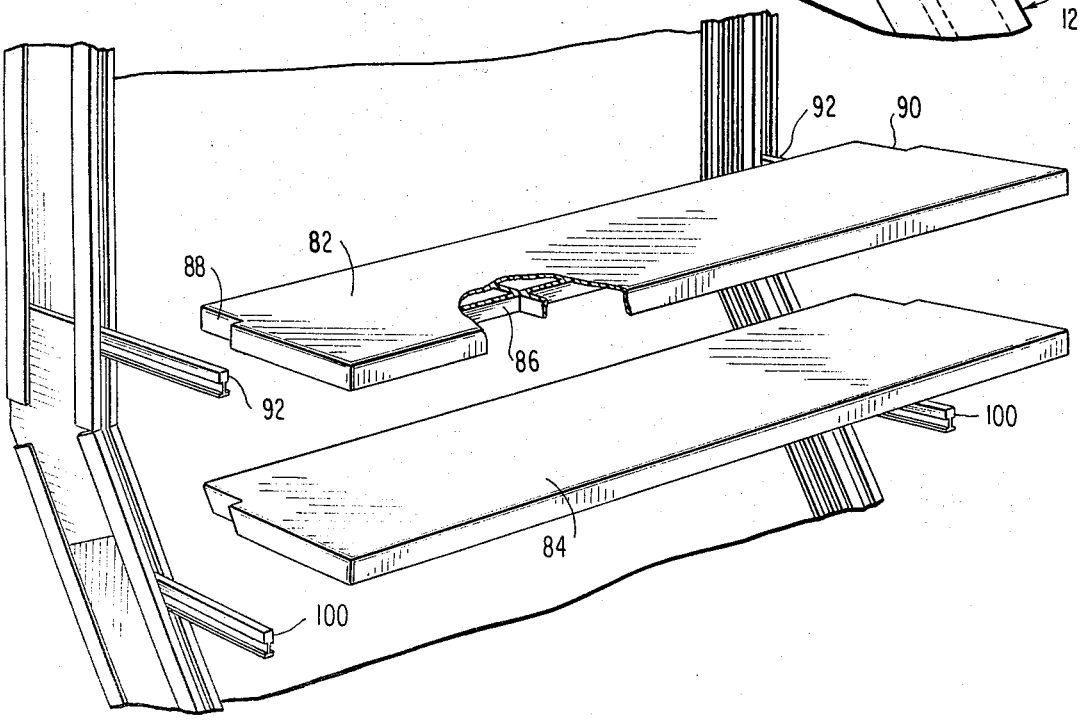

PORTABLE EXHIBIT SYSTEM

BACKGROUND OF THE INVENTION

The present invention is directed to an exhibit system and more specifically to a light-weight portable exhibit system having readily detachable interfitting parts including an illuminated header and rear illuminated modules.

At various trade shows it was customary for exhibiters to set up a booth or display stand on their allotted floor space to provide a suitable backdrop or actual means for supporting their product. The cost of such a booth or display stand has traditionally been extremely high due to the cost of materials for constructing the stands and the high cost of the union labor employed in transporting the booths or stands from trade show to trade show, carrying the stands in and out of the convention hall and assemblying and disassemblying the display stand in the hall. Such display stands or exhibit booths are conventionally made of wood framing having a plywood or fiber board sheath thus requiring the services of a carpenter not only in the initial construction of the parts but in the assembly of the parts at the exhibit site. Such exhibits when disassembled are still very bulky and heavy. Thus, sturdy packing crates are required for shipment and generally such exhibits must be shipped by truck. Thus, standard exhibits of this nature are expensive to build and ship, awkward to handle and time consuming in assembly and disassembly.

In recent years, lightweight portable display stands have become increasingly more popular with exhibitors due to the fact that they may be readily assembled and disassembled without skilled labor and can be stored in shipping cases for transporting from one location to another. In general, such displays comprise a series of light-weight interchangeable components, primarily in the form of panels, which when assembled can form a display booth or a series of interconnected display panels. Such displays, in various sizes ranging from a so-called tabletop display to full size floor displays. By having a series of interconnected panels, the displays may take different shapes so as to accommodate this display to the space available or to particular needs of the exhibitors.

Conventional modular displays generally include a plurality of vertically extending panels which are interconnected by means of vertically extending hinge arrangements so that the panels may be angularly oriented relative to each other so as to be self-supporting. The vertically extending panels may be of varying heights and may be vertically spaced from the floor and from each other by means of interconnected supporting frames. Lighting units supported on horizontally extending arms are available as well as shelves which are adapted to protrude from the supporting frame work for the vertical panels.

In lieu of a framework to which the panels may be secured the vertically exending panels may be provided with integral hinges so that upon folding the vertical panels relative to each other the panels will be free-standing. It is possible to achieve different variations in the configuration of vertically extending panels by stacking vertical panels and joining them by means of interlocking notches formed in the top and bottom edges of mating panels. Horizontal shelving may be provided which will rest on the upper edges of angularly related vertical panels.

SUMMARY OF THE INVENTION

The present invention provides a portable exhibit system which is inexpensive to produce as well as inexpensive to transport, assemble and disassemble. The exhibit system according to the present invention is extremely lightweight and when disassembled is so compact that a single unit of the system can readily be packed into two portable traveling cases. The portable exhibit system according to the present invention can be rapidly assembled by a single person in about 10 minutes without tools.

The portable exhibit system according to the present invention is comprised of one or more basic units each of which is comprised of one to four substantially vertically disposed modules which are detachably interconnected to each other and to a pair of horizontal base supports. The center module is vertically disposed at a right angle to the base supports and upper and bottom modules are angularly oriented relative to the center module on the same side thereof to provide a substantially continuous generally concave display surface. An illuminated header module may be secured to the upper module and the upper, center and bottom modules may be selectively arranged as plain copy modules or as rear illuminated modules for the effective display of color transparencies.

The portable exhibit system according to the present invention may be comprised of a single unit or a plurality of units interconnected to each other in side-by-side relation, back-to-back relation or in separate spaced apart free-standing relation relative to each other.

The portable exhibit system according to the present invention is comprised of one or more units each of which is comprised of one or more modules each of which includes a display portion extending between a pair of parallel identical support extrusions. The support extrusions may be of aluminum or the like and consist of a flat strip having identical oppositely opening channels integrally formed along oppoiste edges thereof. A plurality of parallel spaced apart protrusions on one surface of the strip define a plurality of slots for the reception of display panels. A pair of opposed channels are provided on the opposite side of the strip for receiving flat connector extrusions which are capable of interconnecting the support extrusions at various angles relative to each other. The side support extrusions of the bottom module of each unit may be interconnected with a pair of horizontally disposed support extrusions which are adapted to rest on the floor to support the entire unit. An elongated extrusion of plastic material or the like may be inserted into the lowermost channel of the horizontally disposed support extrusions to provide an antiskid, anti-marking support and extruded channel covers may be disposed in the oppositely opening channels for decorative purposes if so desired.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 1 is an exploded perspective view of a typical single unit of the portable exhibit system according to the present invention.

FIG. 2 is a side elevation of an assembled unit according to the present invention.

FIG. 3 is a sectional view taken along the line 3—3 of FIG. 2.

FIG. 4 is a sectional view taken along the line 4—4 of FIG. 2 with the display panel broken and one of the channel cover extrusions illustrated in spaced relation to the channel.

FIG. 5 is a partial view of a unit showing two different types of shelves in spaced relation to the support brackets therefor.

FIG. 6 is a detailed view, partly in section, of the mounting arrangement for the shelves shown in FIG. 5.

FIG. 7 is a detailed view, partly in section, of the mounting arrangement for a horizontal shelf with a vertical module.

FIG. 8 is a detailed view, partly in section, of the mounting arrangement for a horizontal shelf with an angularly disposed module.

DETAILED DESCRIPTION OF THE INVENTION

Figure 10:
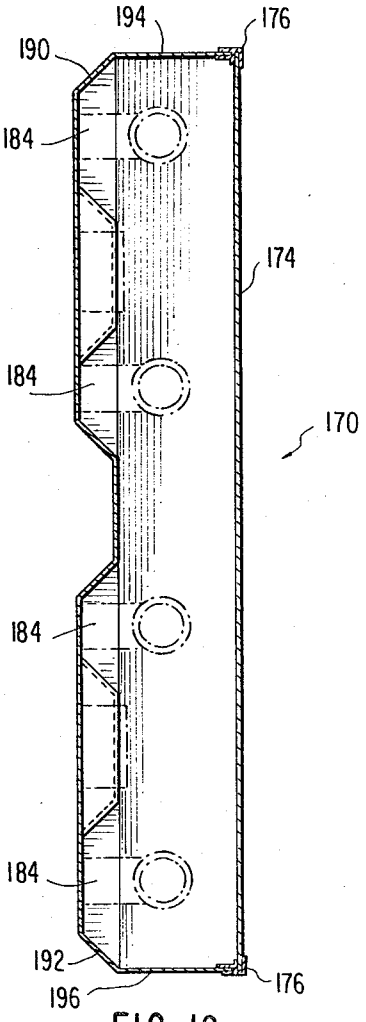
FIG. 10 is a vertical sectional view of the assembled rear illuminated module shown in FIG. 9.

The portable exhibit system according to the present invention is comprised of one or more basic units which may be arranged in various positions with respect to each other. A typical basic unit 10 is shown in FIG. 1 and is comprised of a bottom module 12, a center module 14, an upper module 16 and a header module 18 interconnected with each other and supported by a pair of support extrusions 20 and 22 as best seen in FIG. 2. The bottom, center and upper modules 12, 14 and 16 as shown in FIG. 1 are of identical construction but may be individually varied insofar as the display portion of the module is concerned without varying the overall size or more of interconnection. The bottom module 12 is comprised of a pair of identical parallel panel support extrusions 24 and 26 having a display panel 28 interconnected therebetween. A typical display panel 28 is constructed of a sheet of fire-retardent polyurethane foam sandwiched between two thin skins of fiberglass.

The panel support extrusions 24 and 26 are identical for each of the modules 12, 14 and 16 and have the same cross-sectional configuration as the support extrusions 20 and 22. The only difference between the panel support extrusions 24 and 26 and the support extrusions 20 and 22 is that the length of the support extrusions 20 and 22 is shorter than the length of the panel support extrusions 24 and 26. A cross-sectional view of the support extrusion 20 is shown in FIG. 3 and would be identical for each of the other extrusions. Each extrusion may be of aluminum or the like and consists of a flat strip 30 having identical oppositely opening channels 32 and 34 integrally formed along opposite edges thereof. First and second protrusions 36 and 38 extend from one surface of the strip 30 parallel to the bases of channels 32 and 34, respectively to define a pair of slots for the reception of display panels such as display panel 28 shown in FIG. 1. Two additional parallel protrusions 40 and 42 extend from the same surface of the strip 30 intermediate the protrusions 36 and 38 to define therebetween a third slot for the reception of a display panel. The opposed faces of each slot are provided with angled gripping teeth to assist in securing a panel within a particular slot. A plurality of ribs 44 and 46 extend from the same surface of the strip 30 intermediate the protrusions 36 and 40 and 38 and 42, respectively to provide additional structural strength for the extrusion. A pair of flanges 48 and 50 extend from the base of the channels 32 and 34, respectively, in spaced parallel relation to the strip 30 on the opposite sides thereof from the protrusions and ribs to define a pair of opposed recesses 52 and 54, respectively, for the reception of a connector element such as the connector element 56. An elongated extrusion 58 of plastics material or the like may be slidably interconnected with the channel 34 when the extrusion is utilized as a horizontal support as in FIGS. 2 and 3.

The connector elements for connecting the various extrusions together to define a pair of upright supports for each unit have varying configurations depending upon the positions in which the elements are to be used. Each of the connector elements is flat and has a thickness sufficient to provide a close sliding frictional fit within the recesses 52 and 54 of each support extrusion. The connector element 56 as illustrated in FIGS. 1–3 is comprised of two arms disposed at an acute angle relative to each other and a laterally extending flange 57 to provide additional reinforcement against bending of the two arms relative to each other. The connector elements 56 are used to interconnect the horizontal support extrusions 20 and 22 with the support extrusions 24 and 26 of the bottom module 12 so that the bottom module 12 will be disposed at an angle of approximately 30° to the vertical for ease of viewing the display panel thereof. Intermediate connector elements 60 are provided for interconnecting the extrusions of the upper, center and bottom modules. Each intermediate element 60 is comprised of two arms disposed at a 150° angle relative to each other. Stop elements 62 and 64 are provided at the intersection of the two arms to limit the degree of insertion of the connector elements into the recesses 52 and 54 of the support extrusions. By providing a 150° angle betweenn the arms of the connector element 60, the center module 14 will be disposed perpendicular to the horizontal supports 20 and 22 and the upper module 16 will be tilted forwardly at an angle of 30° relative to the vertical. Thus, when the upper, center and bottom modules are interconnected as shown in FIG. 2 a substantially continuous concave display surface will be provided.

When a module is constructed with only a single display panel 28 as illustrated in FIGS. 1 and 4 the display panel 28 is generally inserted in the middle slot of each support extrusion defined by the protrusion 40 and 42. The display panel 28 may, however, be disposed in either of the other slots as shown by dotted lines in FIG. 4. Each display panel 28 is comprised of fire-retardent polyurethane foam 66 sandwiched between two thin skins of fiberglass 68 and 70 which are bonded thereto by any suitable means. In order to provide a finished effect for each display module a channel cover 72 of extruded plastic is provided with a pair of flexible legs 74 and 76 which are adapted to snap into the opposed flanges 78 and 80 respectively which define the channels 32 and 34 of each extrusion as shown in FIG. 4.

Each unit of the portable display system may be provided with two different types of horizontally disposed shelves 82 and 84. The shelves are constructed of molded plastics material or the like and are provided with integral intersecting ribs 86 on the undersurface thereof to provide additional strength. The shelves 82 are designed for use with the vertically disposed center module and notches 88 and 90 are provided to accommodate the support extrusions 24 and 26 of the center module. The vertical surfaces of the notches 88 and 90 which overlap the channels 32 and 34 of the support extrusions 26 and 24, respectively, are provided with an aperture for the reception of elongated support arms 92 which are of extruded aluminum or the like. The width of the arm 92 is slightly less than the distance between the flanges 78 and 80 which define the channels 32 and 34 on the support extrusions so that the support arms 92 may slide along the length of the channels of the center module to adjust the height of the shelf 82. A locking pin 94 protrudes at right angles at opposite sides of each support arm 92 and is disposed within the channel adjacent the top edge of the support arm 92 as shown in FIGS. 6 and 7. The pin 94 is spaced from the end edge 96 of the support arm 92 a sufficient distance to allow vertical sliding movement of the pin within the slot when the shelf 82 is lifted slightly. When the shelf 82 is located in the desired position along the length of the support extrusions 24 and 26 the weight of the shelf will cause a binding of the pin against the inner surfaces of the channel flanges 78 and 80 and the end surface 96 of the arm 92 with the bottom surface of the channel to lock the shelf 82 at the desired elevation. The construction of the shelf 84 is similar to the construction of the shelf 82 with the exception that the rear surfaces thereof are beveled at an angle of 30° complimentary to the inclination of the bottom module 12 as best seen in FIGS. 5 and 8. The support arms 100 for the shelf 84 are each provided with a pin 102 similar to the pin 94 of the support arms 92 and the end surface of each support arm 100 is beveled at a 30° angle to match the inclination of the bottom surface of the channel of the support extrusions 24 and 26. When it is desired to adjust the height of the shelf 84 a slight upward tilt of the shelf will allow the pin 102 to slide along the respective channel and when the shelf 84 is in the desired position the weight of the shelf will cause a binding of the pin 102 against the flanges 78 and 80 of the channel and the rear surface 104 of the arm 100 against the bottom channel to prevent sliding movement.

Figures 11, 12:
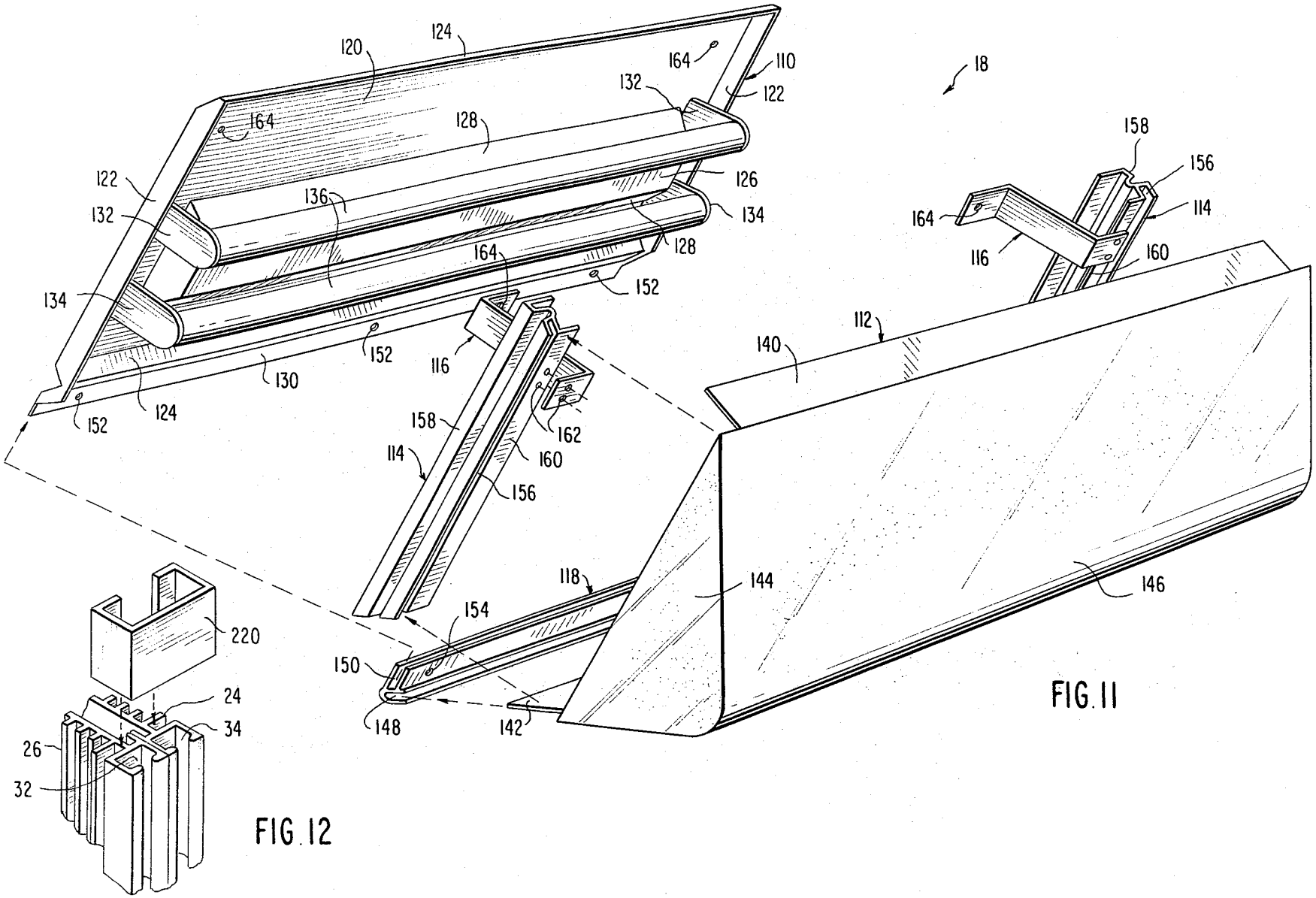
FIG. 11 is an exploded view of an illuminated header module.
FIG. 12 is a detailed view showing a connector for joining two units in side-by-side relation.

In addition to the three basic modules 12, 14 and 16 and the supports therefor, a basic display unit may also include an illuminated header assembly 18 as shown in FIGS. 1, 2 and 11. The header assembly 18 is comprised of a mounting panel 110, a lens member 112, a pair of support extrusions 114, a pair of connecting brackets 116, and a header interlock molding 118. The mounting panel 110 is basically a flat pan-like member 120 having perpendicular end flanges 122 and angled side flanges 124 extending the length of the panel. The pan-like member 120 is provided with a raised center portion 126 having sloping side surfaces 128 extending substantially the entire length of the panel member 120. A connecting flange 130 extends along the entire length of the panel adjacent the surface 124. The flat panlike member, the flanges and raised center portion may be constructed of sheet metal or the like with the surfaces thereof facing the lens member 112 having high light reflective capability. Two pairs of light supports 132 and 134 are mounted at opposite ends of the raised center portion 126 and receive fluorescent lighting tubes 136 which extend the entire length of the raised center portion on opposite sides thereof in closely spaced relation to the sloping surfaces 128 of the raised center portion 126.

The lens member 112 is a one piece member of molded translucent plastic material having an upper flange 140, a lower flange 142, substantially triangular end portions 144 and a curved main portion 146 which extends the entire width of the basic unit 10 from the entrance to channel 32 to the entrance of channel 34 at opposite sides of the basic unit. The header interlock molding 118 is comprised of a one piece extrusion of aluminum or the like having a pair of open channels 148 and 150 disposed at an angle of approximately 112 is secured in channel 148 by any suitable means such as an adhesive or the like. The flange 130 of mounting panel 110 is detachably secured in the channel 150 by means of nut and bolt assemblies (not shown) which extend through holes 152 in the flange 130 and complementary holes 154, only one, of which is shown, extending through the flanges of the interlocking molding 118 which define the channel 150.

The header support extrusions 114 are identical to each other, but one of the extrusions is inverted to present a mirror image of the other. Each extrusion 114 is provided with a forwardly facing channel 156 into which the rear edge of an end portion 144 of the lens member 112 is secured by any suitable means such as an adhesive or the like. The external width of the flanges defining the channel 156 are such as to slide between the opposed flanges 78 and 80 which define a channel on the support extrusion 24. Each header support extrusion is also provided with an S-shaped portion integrally formed with the channel 156 and adapted to slide within channels 32 and 34 of the panel support extrusions. A flange 160 extends perpendicular to the channel 156 and is adapted to overlie the face of the flange 80 on the panel support extrusion. The flanges 60 on the header support extrusions 114 therefore extend towards each other as shown in FIG. 11. One flange of each Z-shaped bracket 116 is secured to each flange 160 by any suitble means such as nuts or bolts (not shown) extending through the complimentary holes 162 and the other flange of each Z-shaped bracket 116 is secured to the flat pan 120 of the mounting panel 110 by any suitable means such as nuts and bolts (not shown) extending through complementary holes 164. Thus, the lens member 112 is permanently secured to the header interlock molding 118 and the two header support extrusions 114, while the mounting panel 110 is detachably connected to the brackets 116 and the header interlock molding 118 to allow servicing of the light fixtures. With the various elements of the header assembly 18 secured together, the entire header assembly may be detachably connected to the upper module 16 by slding the S-shaped portions 158 of the header support extrusions 114 into the channels 32 and 34 on the front of the upper module 16. The flange 112 on the lens member 146 of the header assembly overlies and engages the panel 28 of the upper module 16 when it is disposed in an intermediate position, thereby limiting the downward movement of the header assembly and locating the header assembly at the top of the upper module 16 as illustrated in FIG. 2.

Figure 9:
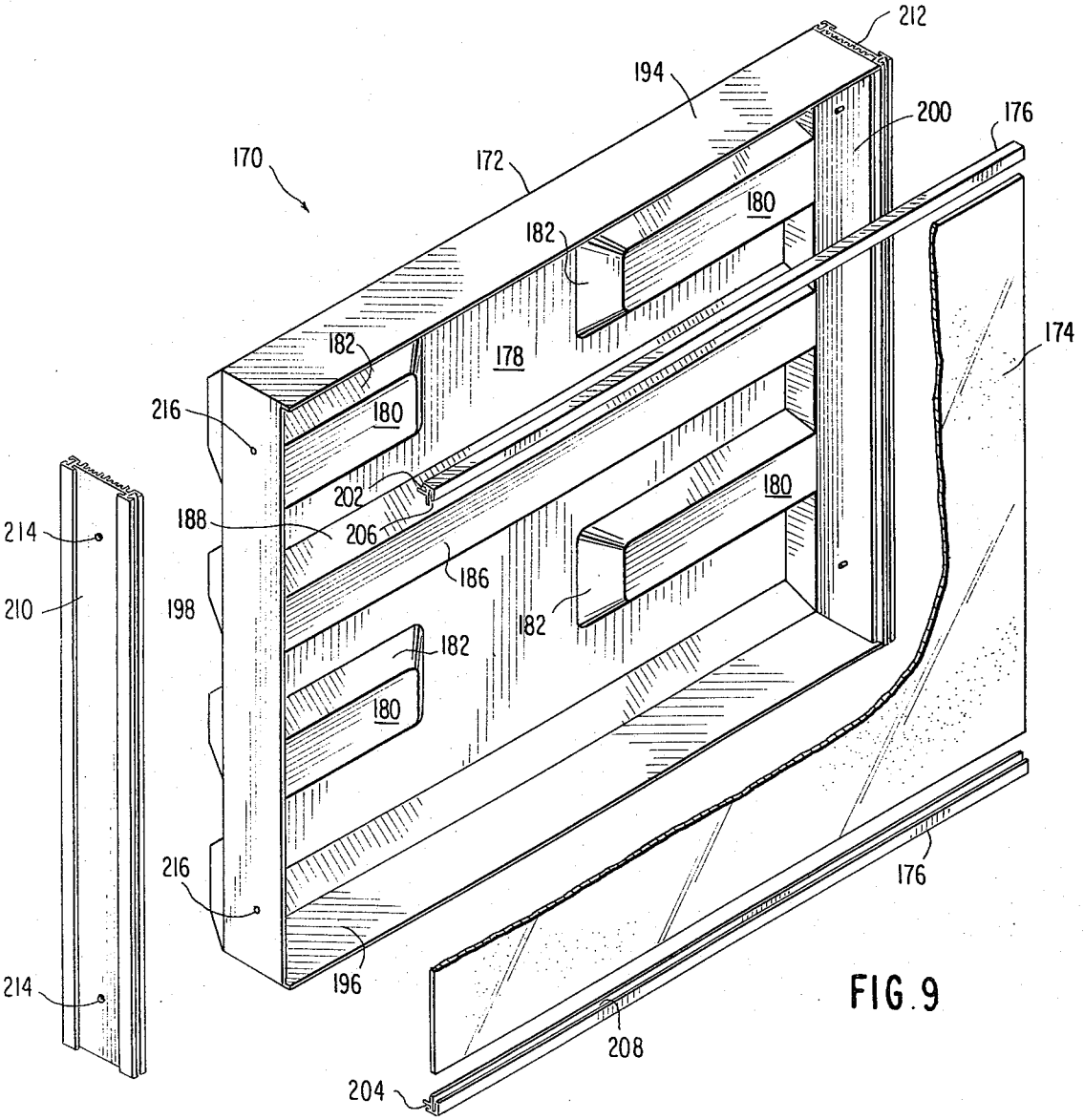
FIG. 9 is an exploded view of a rear illuminated display module.

While the lower, middle and upper modules 12, 14 and 16 have each been illustrated in FIG. 1 with a single flat display panel 28 incorporated therein, any one one or all of these modules may be provided with a light box assembly 170 as illustrated in FIGS. 9 and 10 which is suitable for displaying transparencies. The light box assembly 170 is comprised of a substantially rectilinear light box housing 172 and a flat lens or light diffuser 174 detachably connected thereto by a pair of idential edge moldings 176. The housing 172 may be constructed of sheet metal or the like and includes a flat bottom surface 178 having four raised portions 180 with sloping side surfaces 182 extending about three sides thereof to assist in reflecting light and to provide stability for the flat bottom 178. Four identical fluorescent light fixtures 184, illustrated in phantom lines in FIG. 10, are located in pairs on opposite sides of the projections 180. A further longitudinal projection 186 having sloping sides 188 extends the entire width of the light box between the two pairs of fluorescent light fixtures. The top and bottom edges 190 and 192 of the bottom member 178 slope upwardly to the top and bottom sides 194 and 196 of the housing 172. The top and bottom sides 194 and 196 are deeper than the sides 198 and 200 of the light box housing 172 to facilitate engagement of the forward edges thereof in channels 202 and 204 of the edge molding strips 176. The top and bottom edges of the light diffuser 124 are adapted to be secured in the channels 206, 208 respectively of the edge molding strips 176 for detachably securing the diffuser 174 to the housing 172. In the construction of the light box assembly, the support extrusions 210 and 212 are identical to the panel support extrusions 24 and 26 shown in FIGS. 1–8, but are further provided with a pair of holes 214 in alignment with holes 216 in the sides 198 and 200 of the light box housing so that the light box housing 172 may be secured to the support extrusions 210 and 212 by any suitable means such as nuts and bolts (not shown) or the like. Thus the support extrusions 210, 212 may be interconnected with other modules in the same manner as the modules are connected in FIGS. 1 and 2. The transparencies (not shown) may be supported in superimposed relation on the light diffuser 174 in any suitable manner. For example, the top and bottom edges of the transparencies could possibly be located in the channels 206 and 208 of the edge molding strips 176 along with the diffuser 174.

As mentioned previously, each display unit 10 may be comprised of all four modules as shown in FIGS. 1 and 2 or only be comprised of one, two or three modules. Likewise, the individual modules 12, 14 and 16 can be constructed with a single display panel 28 at any one of three locations relative to the support extrusions 24 and 26 or any one of the modules 12 and 14 and 16 or all of the modules 12, 14 and 16 may be replaced by a light box assembly module 170. In addition to this a plurality of basic units 10 comprised of any desired number of modules can be interconnected with each other to form a multiple unit display. Two basic units may be connected in side by side relation, as shown in FIG. 12, wherein the abutting support extrusions 24 and 26 are connected together by means of a rectilinear C-shaped clip 220 adapted to be inserted into the channels 32 and 34 for holding the adjacent units together in side by side relation. It is also possible to secure two basic units having any desired number of modules together in back to back relationship by interconnecting the support extrusions 22 and 24 of each unit by means of a flat rectangular interconnecting strip (not shown) adapted to be frictionally engaged in the channels 52 and 54 of each support extrusion 22 in the same manner in which the connecter 156 is disposed in FIG. 3. Likewise, a plurality of individual free standing basic units 10 can be oriented relative to each other at any desired angle without providing an interconnection between the units. The construction of the individual modules 12, 14 and 16 and the light box module 170 are readily adaptable for providing a concealed wiring arrangement since the cord feeding to the illuminated header assembly 18 as illustrated in FIG. 1 may be run up through the channels of the support extrusions 20, 22, 24 and 26 at the rear of the unit. Similar wiring could be run through the channels to supply electricity to the light box assembly 170 at wherever such a light box assembly might be located.

Although the invention has been shown and described with reference to a preferred embodiment thereof, it will be understood by those in the art that various changes in form and details may be made therein without departing from the spirit and scope of the invention.

What is claimed is:

1. A portable exhibit system comprising at least one display module having a pair of identical mirror image side support extrusions, display means extending between and detachably connected to said side support extrusions, a pair of bottom support extrusions having a cross-sectional configuration identical to said side support extrusions and a pair of connector means detachably connecting said side support extrusions to said bottom support extrusions, respectively at an acute angle.

2. A portable exhibit system as set forth in claim 1, further comprising a second display module having a pair of identical mirror image side support extrusions with a cross-sectional configuration identical to said side support extrusions of said one module display means extending between and detachably connected to said side support extrusions and additional connecting means detachably connecting said side support extrusions of said second module to said side support extrusions of said one module with said second module being disposed orthoganal to said bottom support extrusions.

3. A portable exhibit system as set forth in claim 2, further comprising a third display module having a pair of identical mirror image side support extrusions with a cross-sectional configuration identical to said side support extrusions of said second module, display means extending between and detachably connected to said side support extrusions and another pair of said additional connector means detachably interconnecting said third module to said second module at an oblique angle relative thereto.

4. A portable exhibit system as set forth in claim 3, further comprising an illuminated header module having means adapatedto detachably secure said header module to the upper ends of the side support extrusions of said third module in overlying relation to said display means of said third module.

5. A portable exhibit system as set forth in any one of claims 1–3, wherein said display means is comprised of a rectilinear flat display panel.

6. A portable exhibit system as set forth in claim 5, wherein said flat panel is comprised of a sheet of fire retardent polyurethane foam sandwiched between two thin skins of fiberglass.

7. A portable exhibit system as set forth in any one of claims 1–3, wherein said display means is comprised of a rectilinear support panel having lighting means thereon, a flat rectilinear translucent panel and means for detachably connecting said translucent panel to said support panel.

8. A portable exhibit system as set forth in any one of claims 1–3, wherein each of said support extrusions is comprised of an elongated relatively flat strip having a plurality of parallel projections extending the entire length thereof defining a plurality of parallel slots, first flange means extending the length of said strip at opposite sides of said strip to define an oppositely opening channel at each side of said strip and second flange means extending from said first flange means in parallel overlying spaced relation to said strip to define a pair of opposed recesses on the opposite side of said strip from said protrusions.

9. A portable exhibit system as set forth in claim 8, wherein said display means is comprised of a rectilinear flat panel having a thickness sufficient to provide a close frictional fit of the edges of said panel in a pair of opposed slots on said side support extrusions.

10. A portable exhibit system as set forth in claim 9, wherein said side support extrusions are provided with three pairs of equally spaced apart slots in which said display panels may be selectively placed.

11. A portable exhibit system as set forth in claim 4, wherein said illuminated header module is comprised of a support panel having light means thereon, a pair of header support extrusions detachably connected to said support panel at opposite sides thereof, a lens member connected to said header support extrusions at opposite sides thereof and a header interlock molding extending along and secured to the lower edge of said lens and detachably secured to the lower edge of said support panel.

12. A portable exhibit system as set forth in claim 11, wherein each of said side support extrusions is provided with a pair of oppositely opening C-shaped channels extending along opposite longitudinal edges thereof and said header support extrusions are provided with flange means complimentary to said Cshaped channels for slidable reception therein to receive and support said illuminated header module between the side support extrusions of a module which includes a flat display panel, said illuminated header module further having stop means for limiting the sliding movement of said illuminated header module in said C-shaped channels of a display module.

13. A portable exhibit system as set forth in claim 12, further comprising cover means detachably connectable to said C-shaped channel means to cover the opening to said C-shaped channel means in said side support extrusion.

14. A portable exhibit system as set forth in claim 11, further comprising C-shaped clip means engageable in the C-shaped channel means of two adjacent modules for connecting two adjacent modules together in side-by-side relation.

15. A portable exhibit system as set forth in claim 11, further comprising shelf means having a pair of parallel support means extending perpendicular to said shelf means and adapted to be disposed in sliding engagement in said C-shaped channels and locking means on the ends of said projection means adapted to be slidable in said C-shaped channels to hold said shelf means at any adjusted position along the length of said side support extrusions of a display module.

16. A portable exhibit system as set forth in claim 15, wherein said projecting means is beveled at an angle equal to the acute angle of said connector means connecting said one module to said bottom support extrusions whereby said shelf means will be maintained parallel to said bottom support extrusions.

17. A portable exhibit system as set forth in claim 11, further comprising wiring means for said header module, said wiring means being located in said C-shaped channels of said side support extrusions to substantially hide said wiring means.

* * * * *